United States Patent [19]

Kemper

[11] 4,307,886

[45] Dec. 29, 1981

[54] AMALGAMATED DESIGN GAME

[76] Inventor: Kenneth E. Kemper, 115 NW. 22nd Pl., No. 5, Portland, Oreg. 97210

[21] Appl. No.: 69,400

[22] Filed: Aug. 24, 1979

[51] Int. Cl.[3] ..... A63F 9/08; A63F 3/00

[52] U.S. Cl. ..... 273/239; 273/157 R

[58] Field of Search ..... 273/157 R, 284, 239; 35/27, 28; 434/96, 104

[56] References Cited

U.S. PATENT DOCUMENTS

| | | | |
|---|---|---|---|
| 191,167 | 5/1877 | Mueller | 35/27 |
| 1,453,728 | 5/1923 | Rhodes | 35/27 |
| 2,002,077 | 5/1935 | Darling et al. | 273/157 R |
| 3,189,350 | 6/1965 | Hopkins | 273/153 R |
| 3,464,145 | 9/1969 | Martin | 273/157 R X |
| 3,755,923 | 9/1973 | Krahn | 35/27 |

FOREIGN PATENT DOCUMENTS

| | | | |
|---|---|---|---|
| 1062570 | 4/1954 | France | 273/157 R |
| 1166195 | 11/1958 | France | 273/157 R |

*Primary Examiner*—Richard J. Apley

*Assistant Examiner*—Scott L. Brown

*Attorney, Agent, or Firm*—John E. Reilly

[57] ABSTRACT

A game includes a plurality of cubical blocks, six distinct but interrelated designs, each of which is divided into the same number of square pieces as the number of blocks in the game. A piece from the same comparable location in each design is affixed to a separate side of a common cubical block. The designs are made and arranged in such a manner that the pieces from comparable locations of the different designs can be interchanged with each other in a variety of combinations to produce amalgamated designs comprised of pieces of several of the individual composite designs. The amalgamable designs are made by starting with one complete design, separating and isolating major elements of the design, selecting a number less than all of the major elements, superimposing them on one another for the base of a new design, and completing the new design by filling in new elements and details not appearing in the first design.

15 Claims, 25 Drawing Figures

AMALGAMATED DESIGN GAME

BACKGROUND OF THE INVENTION

This invention relates to games and amalgamated designs, and more particularly to a game utilizing amalgamable designs and a progressive method of producing such amalgamable designs.

SUMMARY OF THE INVENTION

An object the present invention is to provide a game wherein it is necessary to assemble a complete composite or amalgamated design from a plurality of game pieces having interchangable components of designs in order to win the game.

It is another object of the present invention to provide such a game which includes a plurality of designs separated into individual pieces capable of being interchangeably fit together to produce an amalgamated design, the appearance of which is dependent to some extent on the manner in which the individual game pieces are played by the players.

Still another object of the present invention is to provide a game in which the players can exercise a certain extent of individual influence over the appearance of the final amalgamated design but which influence can also be frustrated under certain conditions by the manner in which an opposing player plays as well as the characteristic limitations of the design components of the game.

It is another object of the present invention to provide a novel and improved game which can provide amusement for an individual or played by a number of people in competition with each other.

It is another object of the present invention to provide a game which is challenging, interesting and amusing, yet which can be played in a short period of time with a number of player opponents in a variety of combinations.

Another object of the present invention is to provide a game wherein the ownership of the individual game pieces is established by proper positioning of a game piece, which ownership can be dispossessed by another player causing the game piece to be removed under certain circumstances.

In accomplishing these and other objects, there has been provided in accordance with the present invention game apparatus having a plurality of surface areas of approximately equal size and shape each of which has an artistic design thereon, the overall appearance of each design being distinct from the totality of each other design. Each of the designs is divided into a pattern of a plurality of physically separate pieces. The pattern of pieces for each design is the same as the pattern of pieces for each of the other design so that pieces from the same location of the pattern of different designs are physically interchangeable with each other.

While each overall design is different than the others, all of the designs have interrelated similarities such that portions of the design in certain sections at the edge of each piece match corresponding sections of at least one corresponding piece of another design. In this manner, pieces of corresponding locations in the pattern are not only physically interchangeable, but some of them also fit together in continuity of design characteristics with certain other pieces such that certain pieces of all the designs can be arranged together to present any of a number of amalgamated designs with no discontinuity in the design at the edge of any of the pieces.

For convenience, the pattern of pieces of each design is comprised of a plurality of equal sized squares which are affixed on the sides of cubical blocks. The piece of each design in comparable location in the common pattern of pieces is positioned on a respective side of a common block. There are six designs, so there are six pieces from different designs of comparable location in the pattern of pieces. Therefore, there is one piece of comparable location in the pattern affixed to each of the six sides of a common cubical block. The pieces on each block are designated with a common number to indicate the proper position of the pieces on that block in the pattern, and each of the pieces is designated to indicate proper orientation with respect to the top, bottom, right and left side of the design.

Designs for the game capable of being amalgamated in variations of the design can be made by the method of first making one complete artistic design, dividing it into individual pieces, reproducing major elements of the design, particularly those elements which extend from one piece to another, on a number of respective transparent sheets or other appropriate medium, selecting less than all of the transparent sheets and superimposing those selected with the design elements thereon over each other to form the base of a new design, filling in the new design with new elements and details different than those in the first design, and dividing the new design into individual pieces of the same pattern, size, and shape as the pieces of the first design. Additional related designs can also be made by selecting a number of major elements of two different designs, combining them together to form the base of still another design and completing the other design by filling in additional elements and details which are different than those of the prior designs.

BRIEF DESCRIPTION OF THE DRAWINGS

Other objects, advantages and capabilities of the present invention will become more apparent as the description proceeds taken in conjunction with the accompanying drawings, in which.

DETAILED DESCRIPTION OF THE PREFERRED EMBODIMENT

Figure 1:
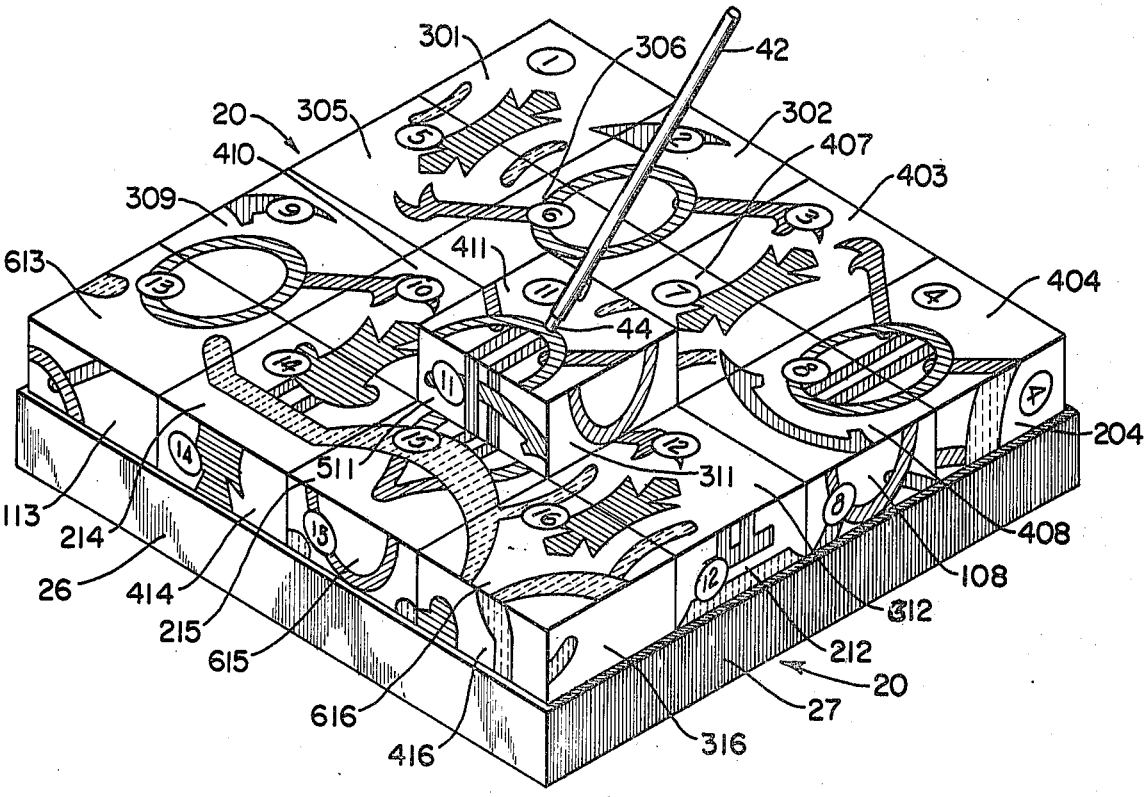
FIG. 1 is a perspective view of the game apparatus of the present invention showing an amalgamated abstract artistic design on the upper surface thereof.
Figure 2:
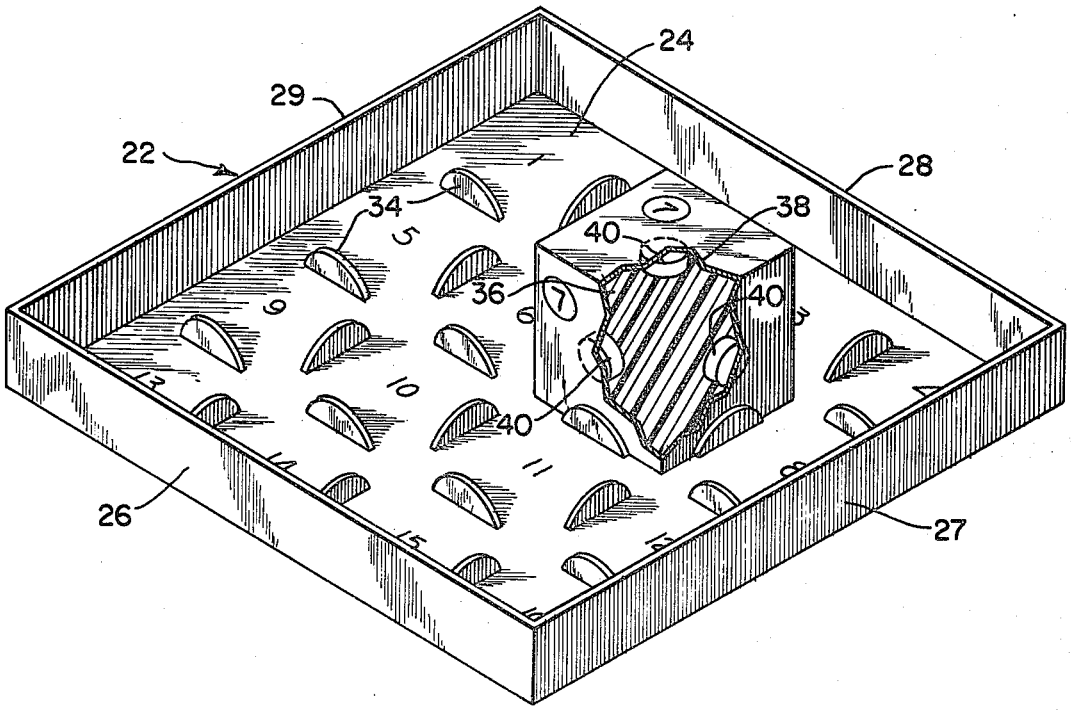
FIG. 2 is a perspective view of the tray portion of the game apparatus with one block properly positioned therein, a portion of the block being cut away to show the construction thereof.

An amalgamated design game 20 in accordance with the present invention is shown in FIG. 1 with a plurality of cubical blocks 1 through 16 positioned together in a square tray 22. The tray 22 is shown in more detail in FIG. 2 and includes a bottom panel 24 with side panels 26, 27, 28, 29 extending upwardly from the edges of the bottom panel 24. The bottom panel 24 is divided into sixteen square sections, each of which is about the same size as a square side of one of the blocks. Each section of the bottom panel 24 is designated by a number corresponding to the number designations on the blocks so that a player can conveniently match the numbers on the blocks with the numbers in the sections on the bottom panel 24 to quickly and conveniently position the blocks 1 through 16 in the appropriate positions in the tray 22. Partition tabs 34 extend upwardly from the bottom panel 24 at the borders of the several sections to retain individual blocks in the proper position. For example, block #7 is shown in FIG. 2 positioned in the appropriate section #7 and retained there by partition tabs 34 on each side of the block.

The game includes six composite designs. Examples of composite designs used in a preferred embodiment of this invention are shown in FIGS. 3 through 8, although any number of different designs could be utilized as long as they are interrelated with each other as will be described herein.

Figure 3:
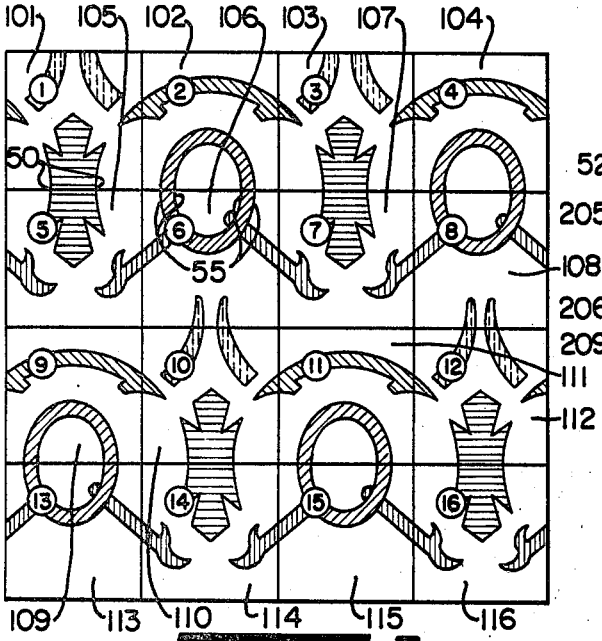
FIG. 3 is a plan view of the first composite design for the game apparatus in FIG. 1, which is divided into sixteen square pieces.

Each of the designs shown in FIGS. 3 through 8 is in totality a composite design separated into a plurality of pieces. Each of the designs is different than the other designs, yet it has some interrelated characteristics to some of the other designs. For example, the design in FIG. 3 is comprised of a number of abstract configurations on a square surface area. The surface area is divided into sixteen separate square pieces 101 through 116, each of which includes a portion of the entire design. The characteristics of the designs include particular abstract configurations in a variety of different colors. Some of the configurations and colors extend from one separate piece to adjacent separate pieces so that proper placement of adjacent pieces next to each other is required to complete the design with continuity of the characteristic design lines, forms, and colors from one piece to the next.

Figure 4:
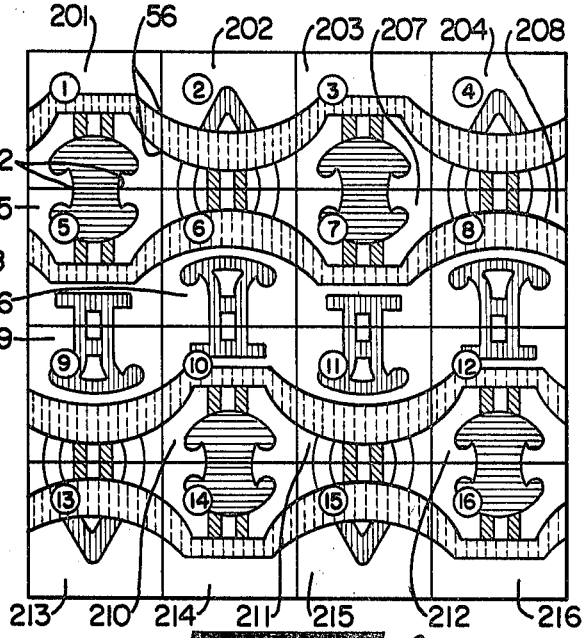
FIG. 4 is a plan view of a second composite design for the game apparatus in FIG. 1.
Figure 5:
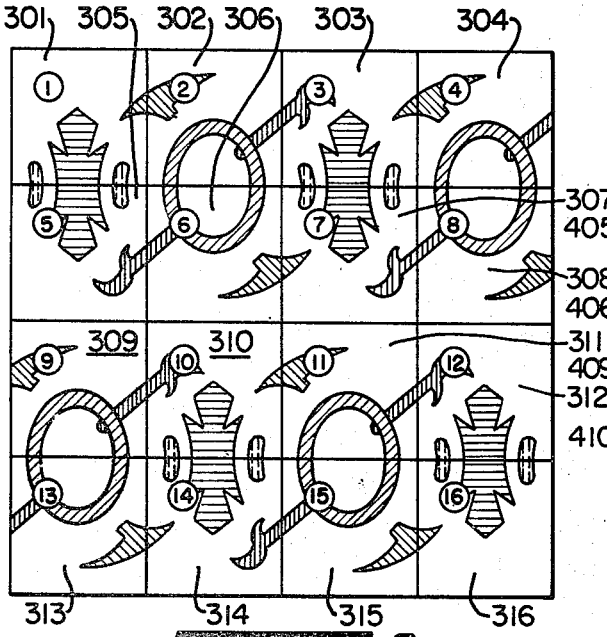
FIG. 5 is a plan view of a third composite design for the game apparatus in FIG. 1.
Figure 6:
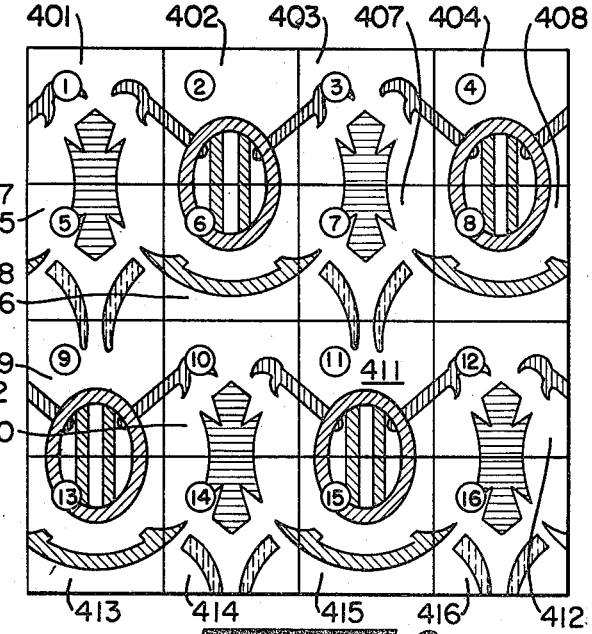
FIG. 6 is a plan view of a fourth composite design for the game apparatus shown in FIG. 1.
Figure 7:
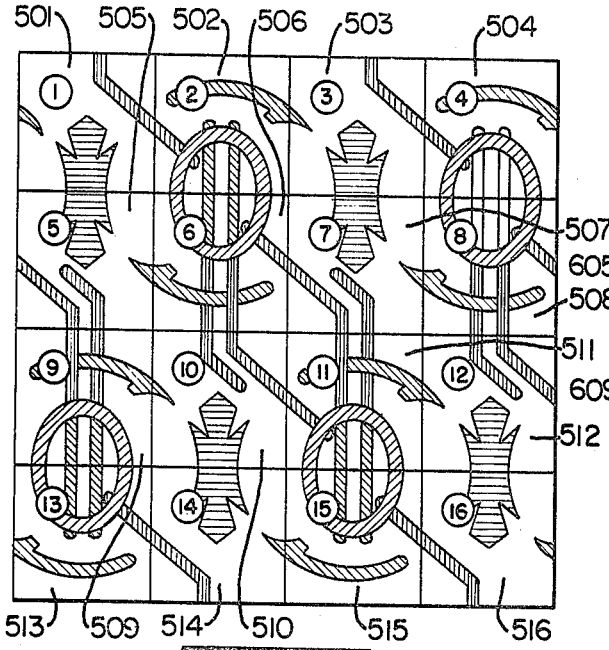
FIG. 7 is a plan view of a fifth composite design for the game apparatus in FIG. 1.
Figure 8:
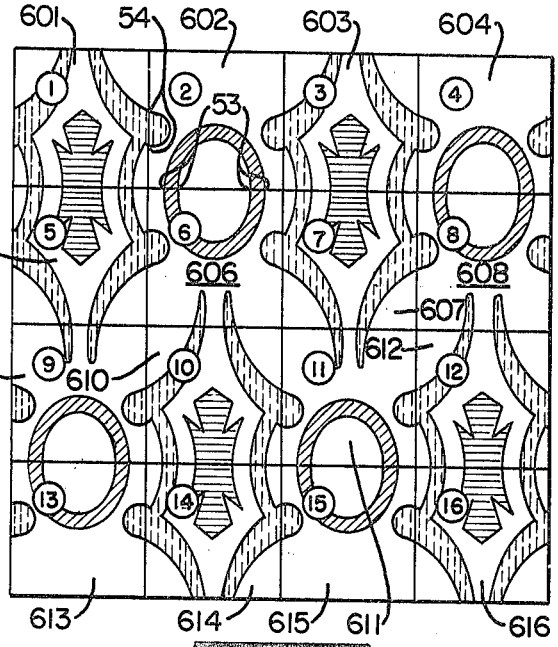
FIG. 8 is a plan view of a sixth composite design for the game apparatus in FIG. 1.

The second design shown in FIG. 4 is different in overall appearance than the first design in FIG. 3, yet some major characteristics of the design in the area adjacent edges of individual pieces match each other, even though the rest of the design characteristics in the interior portions of each piece might be completely different. For example, the portion of the design between lines 50 in FIG. 3 extending between pieces 101 and 105 match in lines, form, and color, the portion of the design between lines 52 in the design in FIG. 4 extending between pieces 201 and 205, although the remainder of the designs in the interior portions of those pieces are much different. Consequently, if piece 101 from the first design in FIG. 3 was replaced by piece 201 from the second design in FIG. 4, the design characteristic lines 50, 52 and color between those lines would be continuous between pieces 201 and 105 at the juncture between those pieces. However, the remaining characteristics of the designs of those respective blocks are quite different and the use of block 201 would substantially change the overall appearance of the first design in FIG. 3. Likewise, if piece 101 was substituted for piece 201 in the second design in FIG. 4, the design characteristic between pieces 101 and 205 would be continuous even though the overall appearance of the design appearance would be different.

Figure 9:
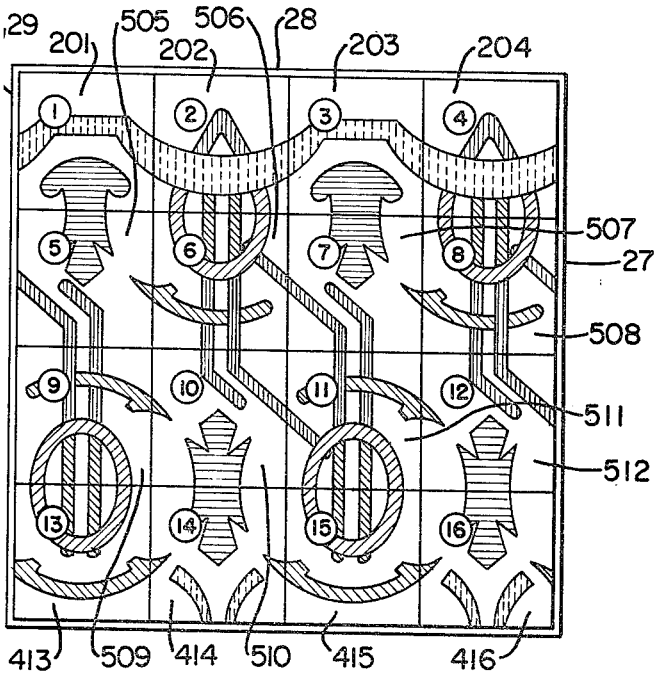
FIG. 9 is a plan view of the game apparatus showing the game pieces correctly positioned to produce a complete amalgamated design comprised of individual pieces of three of the composite designs.

Of course, it is quite apparent that interchanging blocks 101 and 201, while providing continuity between design characteristics with the respective blocks 105 and 205, would result in disjointed design characteristics between adjacent blocks 102 or 202. However, the piece 602 from the sixth design shown in FIG. 8 has a portion along its edge between lines 54 which match in color, form and continuity the portion between lines 56 on piece 201. Further, the portion of the design between lines 53 in piece 602 match the portion of the design between lines 55 in piece 106. Therefore, if piece 101 in FIG. 3 was replaced by piece 201, and if piece 102 was replaced by piece 602, there would be continuity of design among all the pieces 201, 602, 105, and 106 without any interruption of design characteristics over the junctions of those pieces. However, such an exchange would leave a discontinuity between pieces 602 and 103. Therefore, another piece from a comparable location on another design would have to be found to substitute for the piece 103 that would continue the design without any discontinuity. The designs are interrelated with each other in such a manner that at least one other such piece can be found in a comparable location in the pattern in one of the other composite designs to continue the amalgamated design being put together. For example, the use of piece 603 as a substitute for the piece 103 in the example given above would continue the continuity in that portion already put together as described above. However, the use of that piece might create another discontinuity along another junction of pieces which again would require another substitution. In this manner, it is possible to create a number of total amalgamated designs from individual pieces of the original composite designs shown in FIGS. 3 through 8. For example, the amalgamated designs comprised of the top surfaces of blocks 1 through 16 as positioned in FIG. 1 is comprised of pieces 214, 215 from the second composite design in FIG. 4, pieces 301, 302, 305, 306, 309, 312 of the third composite design in FIG. 5, pieces 403, 404, 407, 408, 410, 411, of the fourth composite design in FIG. 6, and pieces 613, 616 of the sixth composite design in FIG. 8. Likewise, another amalgamated design is shown in FIG. 9 which is comprised of pieces 201, 202, 203, 204 of the second composite design in FIG. 4, the pieces 413, 414, 415, 416 of the fourth composite design in FIG. 6, and pieces 505, 506, 507, 508, 509, 510, 511, 512 of the fifth composite design in FIG. 7.

For convenience, the individual square pieces of each design shown in FIGS. 3 through 8 are affixed to separate sides of the sixteen cubical blocks 1 through 16 as shown in FIG. 1. Each square piece from a particular composite design is positioned on a different block. For example, the sixteen square pieces 101 through 116 of the first composite design shown in FIG. 3 are each placed on the side of a separate block 1 through 16 in a manner such that if the sixteen blocks 1 through 16 are positioned together in a square pattern with the proper sides turned upwardly and correctly oriented in relation to the overall design, the overall design shown in FIG. 3 can be presented by the totality of the surfaces of the appropriate sides of the sixteen blocks 1 through 16. The remaining composite designs in FIGS. 4 through 8 are also divided into the sixteen equal squares, each of which is respectively affixed to the side of a separate block.

Further, all of the pieces of the respective designs of comparable location in the pattern of pieces are positioned on respective different sides of the same block. For example, pieces 101, 201, 301, 401, 501, and 601 of the respective designs, all from the upper left corner of the pattern of pieces are positioned on respective different sides of block 1. In this manner, block 1 contains all of the pieces from the upper left corners of the six composite designs. Likewise, block 2 has affixed to its six separate sides respectively all of the pieces 102, 202, 302, 402, 502, and 602, which are the pieces of the separate composite designs comparably located in those designs in the top row and second column of the pattern of pieces. This arrangement is the same for all of the remainder of the pieces of each design affixed to separate sides of the respective cubical blocks.

Each piece is also provided with a designation thereon indicating its proper locality within the pattern of pieces which designation is common to the comparable locality in all of the designs. As shown in the preferred embodiment in FIGS. 1 through 9, these designations are the numerals 1 through 16 which correspond to the number of blocks in the game apparatus and the number of pieces in each composite design. Also, the numeral as positioned on each piece indicates the proper orientation of the piece with respect to top, bottom, left, and right sides of the piece in relation to the other pieces and the overall design. With these designations, the player always knows which of the blocks 1 through 16 contains the appropriate design pieces for the location in which he is interested in filling to create an amalgamated design. For example, if a player desired to fill the space in the lower left corner with a piece of a design, he would know that block 13 would have such a piece affixed on one of its six surfaces. As shown in FIG. 2, and discussed above, the bottom panel 24 of the tray 22 is also divided into sixteen sections by the partition tabs 34, and each section is marked with the numerical designations 1 through 16 which correspond to the comparable positions of the pieces on the blocks 1 through 16 for the proper positioning of those blocks in the pattern to form the designs.

The object of the game is for the players to position the blocks in the appropriate designated spaces for those blocks in the tray 22 in such a manner that the design pieces on the top surfaces of the blocks present a complete design which is continuous in design characteristics of lines, forms, colors and textures from one block to the next. Of course, the combination in which the blocks are placed in the tray determines the overall appearance of the resulting amalgamated design put together by the player. The final design created could be any one of the six composite designs shown in FIGS. 3 through 8, or it could be any one of a number of amalgamated designs which can possibly be created in positioning together pieces taken from several of the different composite designs, such as those amalgamated designs shown in FIGS. 1 and 9. The game ends when such a complete composite design or amalgamated design is achieved with the placement of all sixteen blocks. The player who has successfully placed the most pieces in the final design wins the game.

In playing the game, the players take turns placing blocks in individually selected ones of the appropriately designated spaces in the tray. The number on the top surface of the block must be positioned upright in relation to the top, bottom, left and right of the tray to insure proper orientation of the pieces of the design. As long as a block placed by a player on the tray is not adjacent another block already placed on the tray, it is allowed to remain at least temporarily in the position chosen by the player placing the block. However, if the block is placed adjacent a block already set in place in the tray, the junction between the block placed and those already in place adjacent thereto must be closely examined to determine whether there are any breaks in the continuity of the design characteristics of lines, forms, colors or texture. The placement of a block adjacent another already in place in such a manner that the continuity of the design is broken at the junction of adjacent blocks is forbidden, unless it is found to be impossible to set a particular block in place without forming such a discontinuity on one or more of the junctions. When all players are satisfied that it is impossible to place the block on the board without disrupting the continuity of the design, any player in his turn may use his turn to set that cube in place and he may turn any piece up on that block that he chooses. He will then have the right to remove each and every one of those adjacent blocks which have design characteristics that do not continue across the junction with that block. The block or blocks so removed from the board can be placed back onto the board by any player in his turn; however, it is forbidden to replace any block on the board in such a manner as to result in removal of the same block played in the preceding term which caused the removal of the block being sought to be replaced. After the lapse of one turn following the removal of a block from the tray, the removed block may be returned to the tray with any piece facing upwardly unencumbered by the above restriction. This process continues until a complete continuous composite or amalgamated design is created by all of the blocks in the tray without any empty spaces due to missing blocks and without any breaks in continuity of design characteristic at the junctions between adjacent blocks.

During the play of the game, a record is kept of the respective player who successfully placed each block on the tray with the appropriate design pieces exposed to contribute to the finished design. Of course, if a player has successfully placed a block which is subsequently removed according to the rules described above, he will not receive credit for that block unless he is successful in replacing it again according to the rules to form a portion of the total design. At the end of a game when a design is completed according to the rules, the player who is successful in placing the most blocks with exposed pieces forming a part of the finished design is declared the winner of the game.

Figure 10:
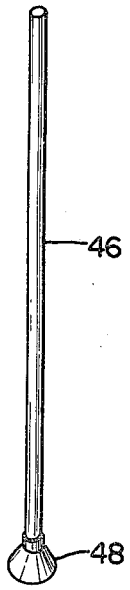
FIG. 10 is a perspective view of an alternate embodiment of the handling device of the present invention.

An additional feature of the game apparatus of the present invention is a releasable handle device for use in removing blocks from the tray, which is particularly useful for those blocks having design pieces in the interior of the tray surrounded by other blocks. This feature is shown in FIGS. 1 and 2. It includes an insert 40 of ferrous or other magnetic material positioned in each side of the block, as shown in block 7 in FIG. 2. The magnetic insert 40 is preferably recessed into the body 36 of the block and covered by a skin 38 having imprinted thereon the design piece appropriate for that side of the block. The body of the block can be formed of any useful material, preferably lightweight material such as styrofoam, plastic, or wood. A handle 42 such as that shown in FIG. 1 has a magnet 44 on one end. The magnet 44 on the end of the handle 42 will attract the magnetic insert 40 in the block and thereby allow the handle 42 to draw the block out of its position in the tray as shown in FIG. 1. An alternative embodiment of such a handle is shown in FIG. 10. It is comprised of an elongated handle 46 with a resilient suction cup 48 on one end thereof. The suction cup 48 can be pressed onto the surface of the block in a conventional manner for such suction cups and the adherence thereof created by the air pressure around the suction cup is sufficient to attach the handle to the block to remove it from the tray.

The preferred embodiment of the game described above is comprised of sixteen cubical blocks, and each design includes some abstract configurations, colors, and forms divided into sixteen equal sized square pieces for affixing on the sides of the sixteen blocks. The dimensions of the blocks are sized such that each side of the block is about the same size as each square piece of the design.

It is understood however that the invention can be comprised of more or less than sixteen blocks, and the designs can be pictorial illustrations as well as abstract, as long as they include interrelated major elements or characteristics between separate pieces of the designs as described above.

Although the pattern of pieces for the six composite designs shown in the preferred embodiment is a plurality of equal sized squares, the game could also be constructed with any of a large variety of patterns including other geometric forms or irregular shapes. Also, depending on the pattern and number of designs used, the blocks could be other forms of polyhedronal bodies or shapes that can be interchanged between designs and fit together.

Figure 11:
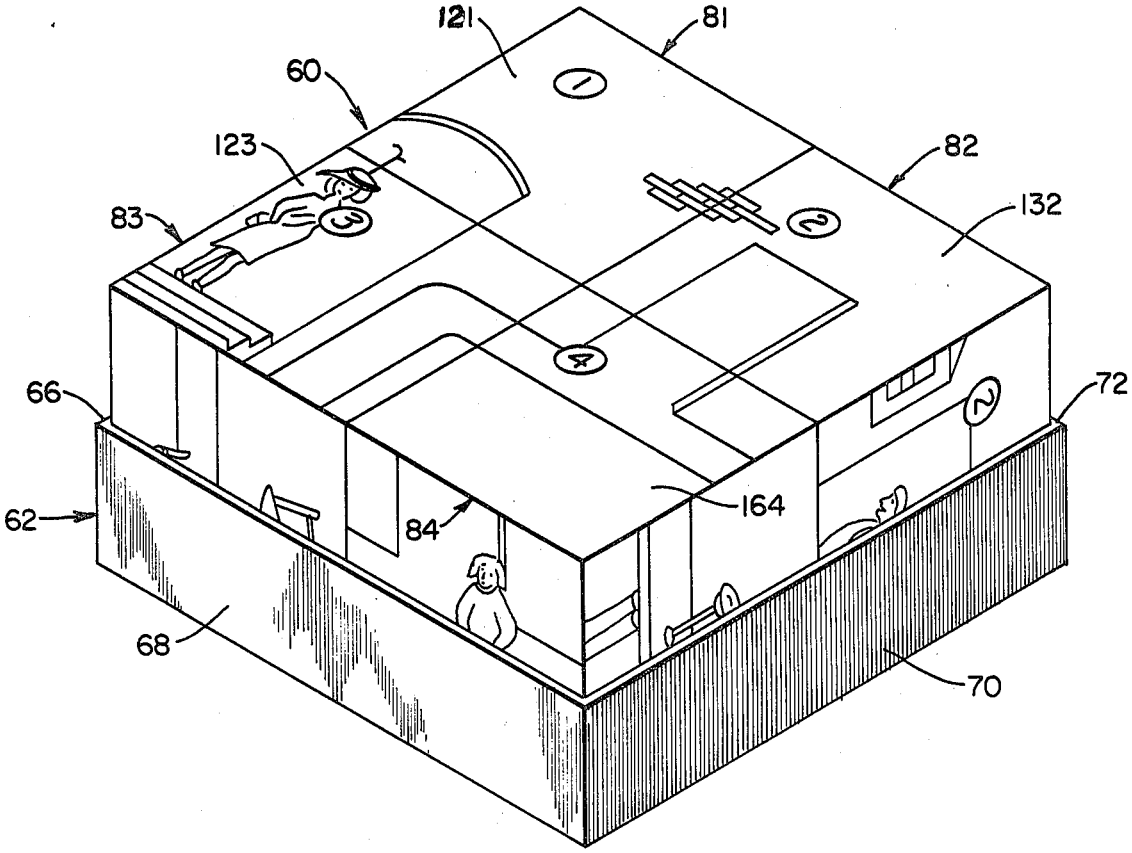
FIG. 11 is a perspective view of an alternate embodiment of the game apparatus of the present invention.
Figure 13:
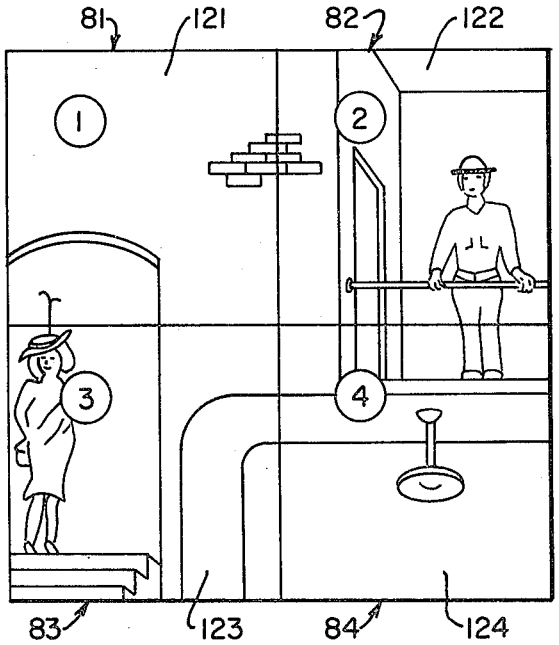
FIG. 13 is a plan view of a second design utilized in the alternative embodiment.
Figure 14:
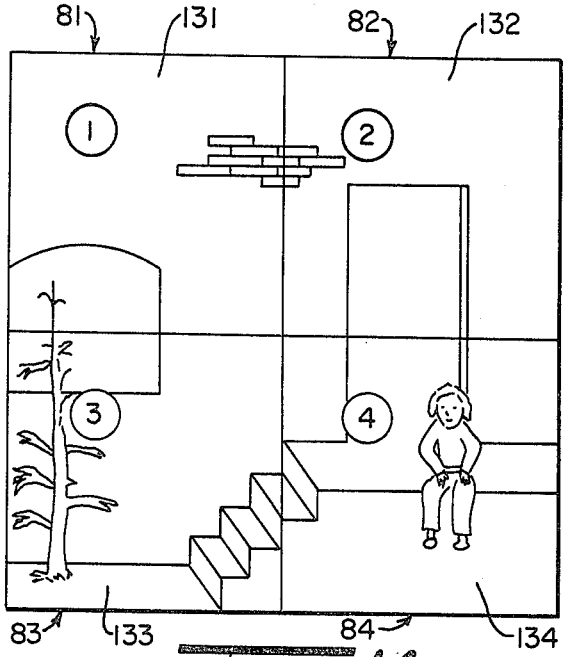
FIG. 14 is a plan view of a third design utilized in the alternate embodiment.
Figure 15:
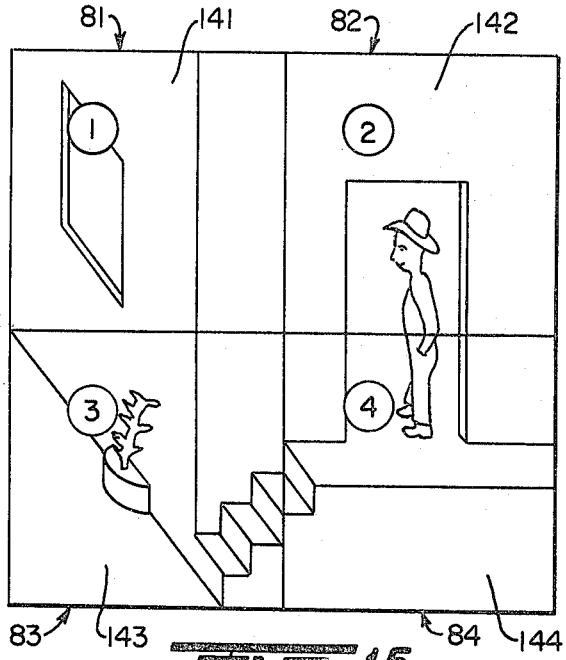
FIG. 15 is a plan view of a fourth design utilized in the alternate embodiment.
Figure 16:
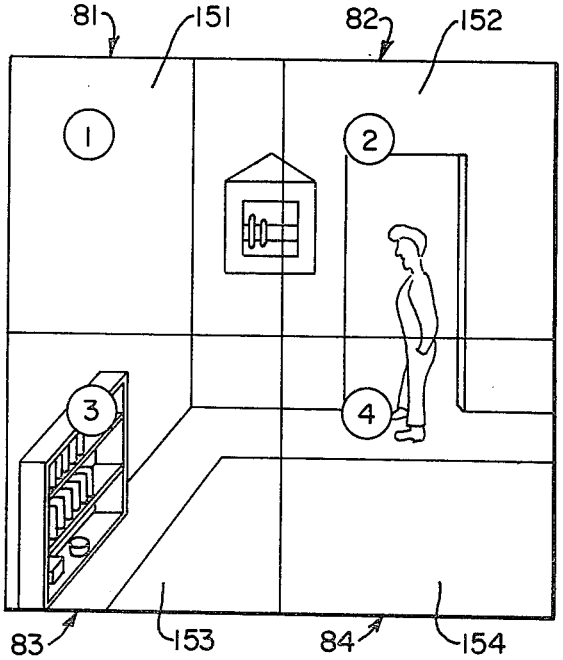
FIG. 16 is a plan view of a fifth design utilized in the alternate embodiment.
Figure 17:
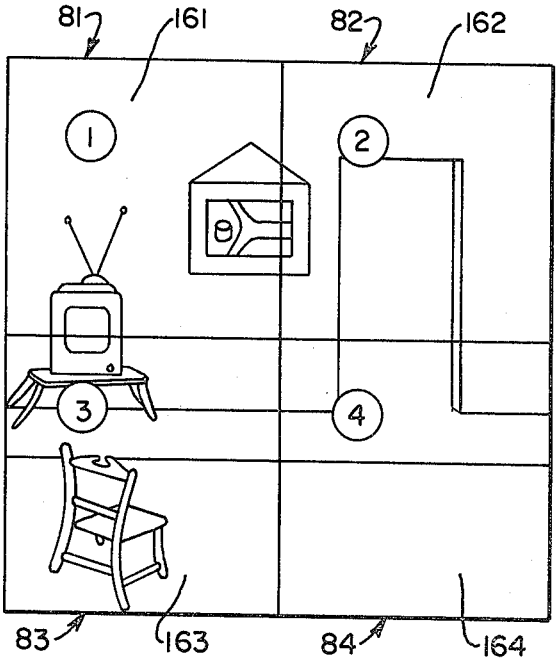
FIG. 17 is a plan view of a sixth design utilized in the alternate embodiment.

An alternative embodiment of the game apparatus is shown in FIG. 11 and is comprised of six composite designs in the form of pictorial illustrations, and each design is divided into four square pieces. Each piece is positioned on the side of the appropriate one of four cubical blocks 81, 82, 83, 84, which fit in tray 68 between sides 66, 68, 70, 72. A first design shown in FIG. 12 in the form of a pictorial illustration is divided into four square pieces 91, 92, 93, 94, each of which is affixed on one side of respectively separate blocks 81 through 84. A second design in FIG. 13 is also divided into four square pieces 121, 122, 123, 124, each of which is affixed on a second side of each of the four blocks 81 through 84. A third design shown in FIG. 14 is also divided into four square pieces 131, 132, 133, 134, each of which is affixed to a third side of each of the four blocks 81 through 84. A fourth design shown in FIG. 15 is divided into four square pieces 141, 142, 143, 144, each of which is affixed respectively to the fourth sides of the blocks 81 through 84. A fifth design shown in FIG. 16 is also divided into four square pieces 151, 152, 153, 154, each of which is affixed respectively to the fifth sides of the blocks 81 through 84. A sixth design is shown in FIG. 17 and is also divided into four square pieces 161, 162, 163, 164, each of which is affixed respectively to the sixth sides of the blocks 81 through 84.

The six designs shown in FIGS. 12 through 17 have interrelated major elements as described in the first embodiment such that a combination of separate pieces of the different composite designs from common locations in the pattern of pieces can be interchanged to form a number of amalgamated designs, such as that shown in FIG. 11. For example, the amalgamated design formed by the pieces turned to the top side of each of the blocks 81 through 84 in FIG. 11 is comprised of piece 121 from the first design in FIG. 13 on block 81, piece 132 from the third design in FIG. 14 on block 82, piece 123 from the second design in FIG. 13 on block 83, and piece 164 from the sixth design in FIG. 17 on block 84.

For simplicity, the designs in the second alternative embodiment will be used to describe the progressive method of making interrelated composite designs as contemplated in this invention which can be separated into pieces and interchanged with comparably located pieces in others of the designs to form amalgamated designs. The first step in making a set of designs for use in this manner is to create from imagination or other source one complete composite design such as that shown in FIG. 12. Next, this first design is divided into a pattern of individual pieces. The pattern of pieces in the alternative embodiment shown in FIGS. 11 through 17 is comprised of four equal squares.

Figure 18:
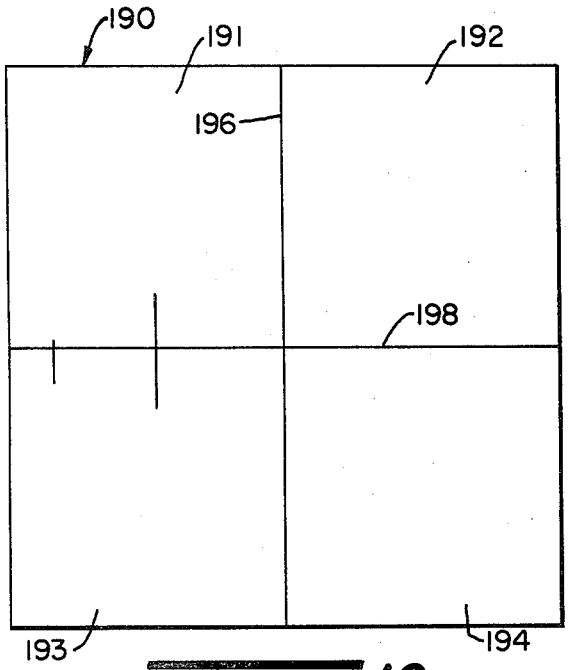
FIG. 18 is a plan view of a first transparency utilized in making the designs for the alternate embodiment.
Figure 19:
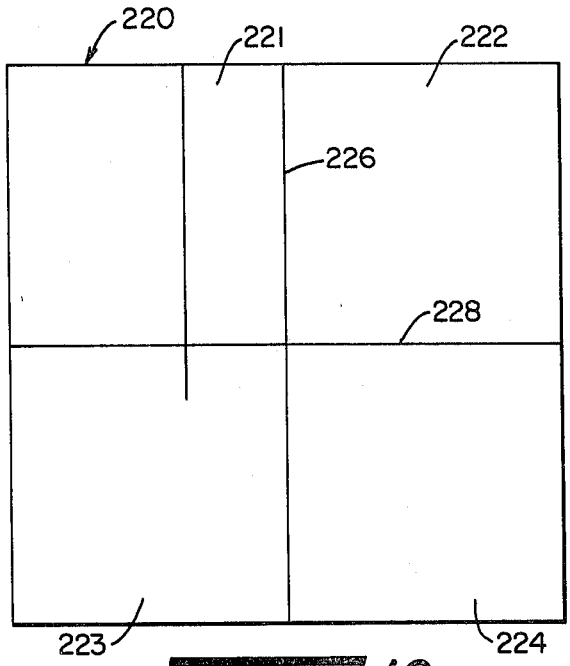
FIG. 19 is a plan view of a second transparency used in making the designs of the alternate embodiment.
Figure 20:
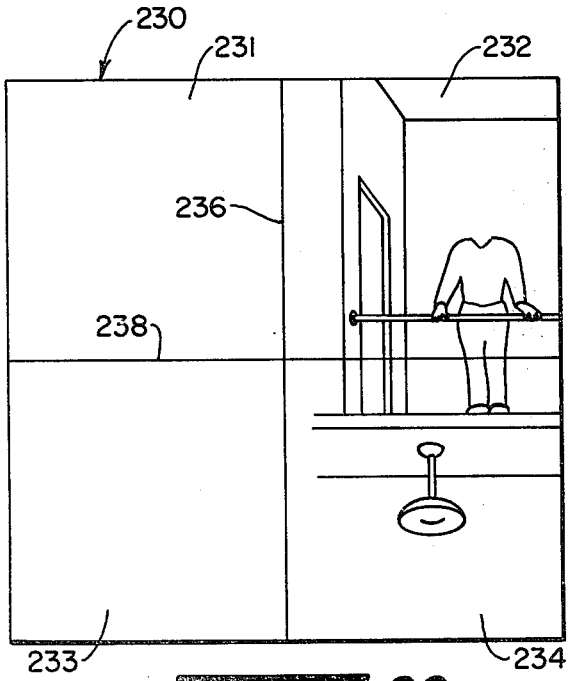
FIG. 20 is a plan view of a third transparency utilized in making the designs of the alternate embodiment.
Figure 21:
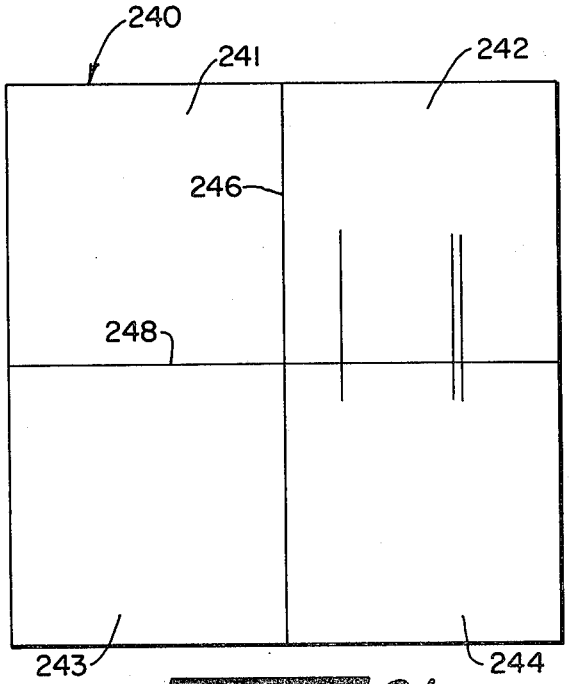
FIG. 21 is a plan view of a fourth transparency utilized in making the designs in the alternate embodiment.
Figure 22:
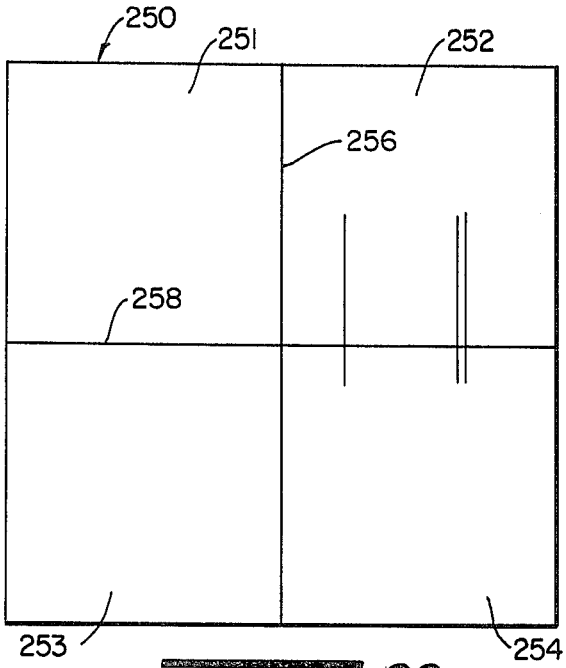
FIG. 22 is a plan view of a fifth transparency utilized in making the designs of the alternate embodiment.
Figure 25:
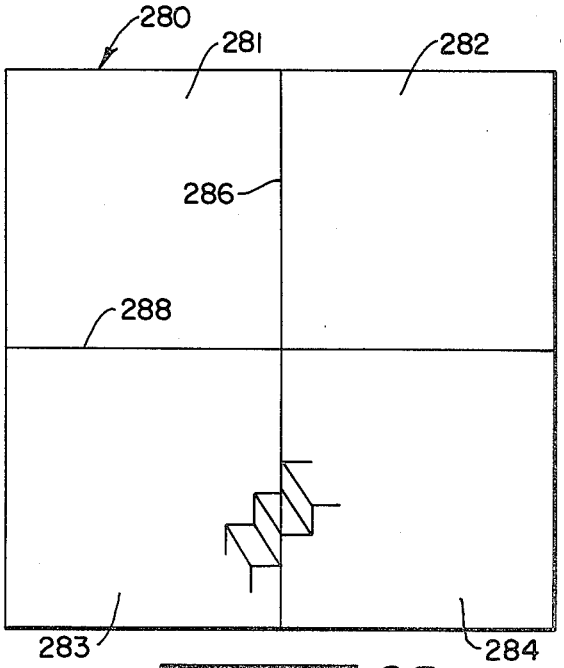
FIG. 25 is a plan view of an eighth transparency utilized in making the designs of the alternate embodiment.

This first design can then be separated into several major elements of design. These elements of design are separated and isolated individually by reproducing them respectively on different transparent sheets or other appropriate mediums. Preferably, the major elements chosen for separation and isolation should extend between at least two separate pieces of the design. For example, a first transparent sheet 190 illustrated in FIG. 18 has reproduced thereon two major elements of the design from FIG. 12 which extend across the dividing line 198 between quadrants 191, 193 of the transparent sheet 190, which quadrants correspond to the pieces 91, 93 of the design in FIG. 12. Another transparent sheet 230 shown in FIG. 20 includes another major element of the design of FIG. 12 which extends over the dividing line 238 between quadrants 232, 234 corresponding to the pieces 92, 94 of the design in FIG. 12. The transparent sheet 280 in FIG. 25 also has reproduced thereon a major element from the first design in FIG. 12 which extends over the dividing line 286 between quadrants 283, 284 of the transparent sheet 280 corresponding to pieces 93, 94 of the design in FIG. 12. Therefore, the major elements on the transparent sheets 190, 230, 280 in FIGS. 18, 20, and 25 go together to form the major portion of the design in FIG. 12.

Figure 12:
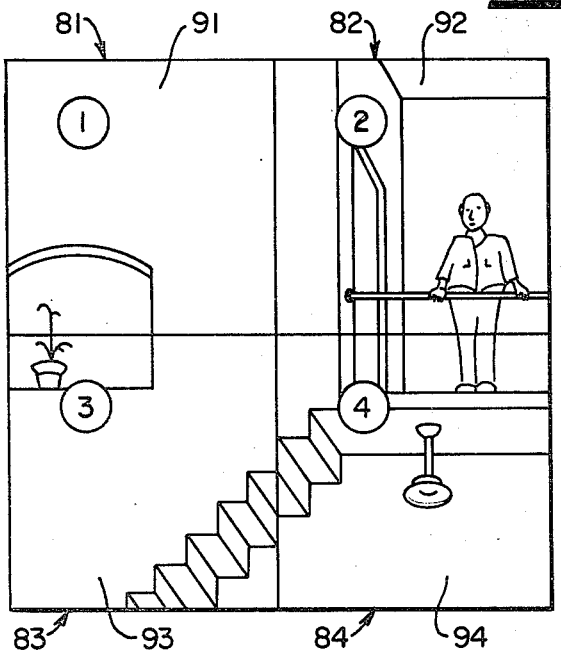
FIG. 12 is a plan view of a first design utilized in the second embodiment.
Figure 23:
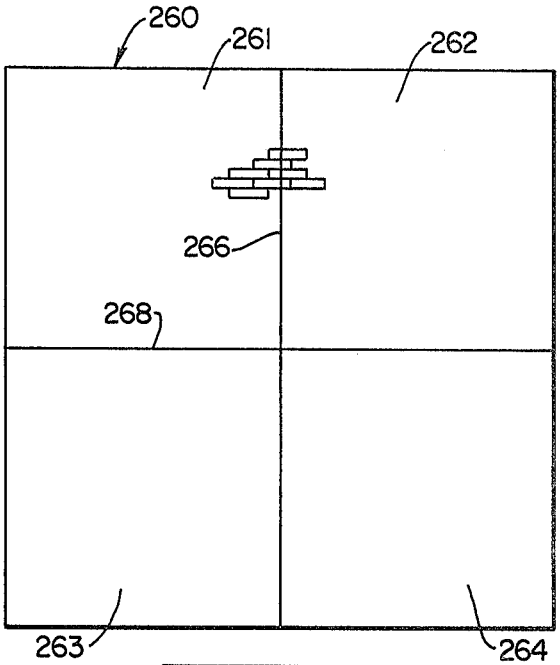
FIG. 23 is a plan view of a sixth transparency utilized in making the designs of the alternate embodiment.
Figure 24:
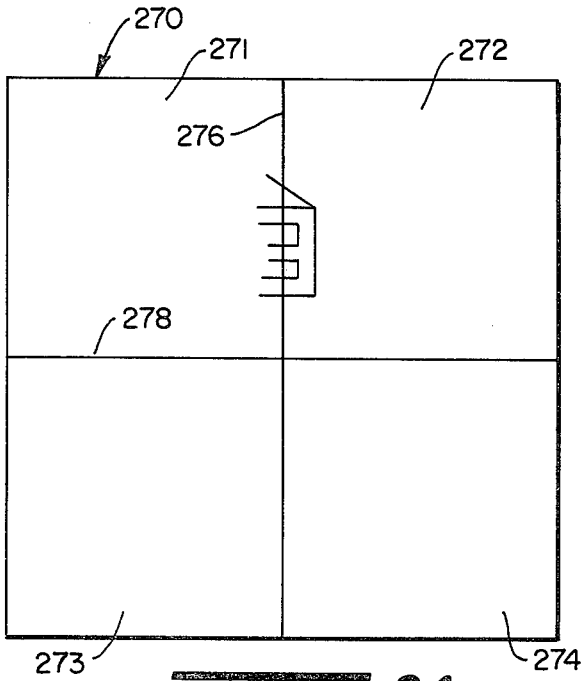
FIG. 24 is a plan view of a seventh transparency utilized in making the designs of the alternate embodiment.

In the next step, one or more but less than all of the transparent sheets 190, 230, 280 with major elements of the design in FIG. 12 thereon could be combined to form a base for a second design. An additional major element can then be created and added to the base of the second design to begin creating a second design, as long as the new major element added is different than any of the elements of the first design. For example, the transparent sheet 260 shown in FIG. 23 includes an added major element extending over the dividing line 266 between quadrants 261, 262. As shown in the drawings, the combination of the elements on transparent sheets 190, 230, and 260 form the base of the second design shown in FIG. 13. The elements on transparent sheets 190, 230 are from the first design, and the element on transparent sheet 260 was added after the elements on transparent sheets 190, 230 were separated and isolated from the first design. Therefore, this combination of elements includes two elements common from the first design and one new element. However, one major element from the first design is not included in this combination. Then, these major elements from the combination of the transparent sheets 190, 230, 260 can be reproduced on another sheet and additional details and elements can be added as desired to complete the second design, for example as shown in FIG. 13. Due to this method of creating the designs, this second design has some characteristics centered around the elements on transparent sheets 190, 230 that are in common with characteristics in the same location in the first design, but the first and second designs both have other characteristics that are distinct from each other.

This same procedure can be used to make a third design, or the base for the third design can be made in another variation of the process by combining transparent sheets having major elements from the first design that were not used in a second design with transparent sheets having major elements appearing only in the second design. This combination will result in base designs that are related to the largest possible numbers of other designs. With a new base thus established, the next step would then be to fill in details and additional elements different than those appearing in designs previously made.

This process for making interrelated designs can be continued progressively until six interrelated composite designs are made. The six designs can then be divided into a pattern of a number of pieces equal to the number of blocks used in the game, and the pieces of comparable locality in the pattern from each design can be affixed to the six sides of the cubical blocks as described above. On larger designs, it is possible to put more elements on a single transparent sheet, especially where the designs are repetitive.

In the drawings, the design in FIG. 12 is comprised of the major elements on transparent sheets 190, 230, and 280. The design in FIG. 13 is comprised of the major elements on transparent sheets 190, 230, and 260. The design in FIG. 14 is comprised of the major elements on transparent sheets 190, 240, and 260. The design in FIG. 15 is comprised of major elements on the transparent sheets 220, 250, and 260. The design shown in FIG. 16 is comprised of major elements on transparent sheets 220, 250, and 270. The design shown in FIG. 17 is comprised of major elements on transparent sheets 240 and 270.

It is also recognized and contemplated that the method of making amalgamable designs as described herein is applicable not only to make games such as those described in this invention, but also for use in other artistic and commercial endeavors. For example, such designs may be made as described above, separated into pieces, and printed on tile for use in covering walls, ceilings and floors. Such use would allow the user of the tiles a greater latitude of artistic creation in laying the tiles to suit his individual taste, and in some cases would allow a more graceful merger of tile design with architectural characteristics. Also, as another example, the designs of this invention can be used in producing an intricate, abstract, two-dimensional work of art which would appear to dance across a motion picture screen in perfect cadence with the beat of music. The amalgamated designs produced in accordance with this invention could offer the artist a more efficient manner of making such designs with significantly reduced time and labor effort.

Although the present invention has been described with a certain degree of particularity, it is understood that the present disclosure has been made by way of example and that changes in details of structure may be made without departing from the spirit thereof.

I claim:

1. Game apparatus comprising:

a plurality composite designs, each said design having a plurality of polyhedronal blocks of substantially equal size and shape, each block having a corresponding number of faces with intersecting edges between adjacent said faces, each face of which has an artistic design thereon forming a component part of one of said composite designs, at least certain design characteristics of each composite design traversing adjacent blocks at the adjoining intersecting edges between said adjacent blocks, each face of a block having a design characteristic at least at one of its intersecting edges corresponding to a design characteristic on an intersecting edge of a face of another comparably located block of at least one other of said designs so as to be interchangeable with each other in the respective designs on said respective sides without a discontinuity of design between intersecting edges of adjacent blocks, and said comparably located blocks having matching intersecting edges with different design characteristics than each other in the interior portions of their respective faces a spaced distance inwardly from their respective edges, and all blocks at each comparable location being marked with a common designation for indicating the proper location of each block.

2. The game apparatus of claim 1, each of said faces of a block having design characteristics on at least one other said intersecting edge which is not the same as the design characteristic of a correspondingly located edge of the comparably located block so as not to be interchangeable with each other in the composite design.

3. The game apparatus of claim 1, wherein each block is marked to indicate the proper orientation thereof within its location.

4. The game apparatus of claim 3, including a support surface for supporting said blocks, said support surface being marked with the pattern of said blocks to outline the proper location on the support surface for each block.

5. The game apparatus of claim 4, including a rectangular tray with a planar bottom panel and four vertical side panels extending upwardly from the bottom panel, the length and width dimensions of the inside of said tray being approximately the same as the length and width dimensions of each of said designs and wherein the bottom panel of said tray is said support surface.

6. The game apparatus of claim 5, including a plurality of retainer members projecting upwardly from the bottom panel of said tray for retaining said blocks in proper position on said support surface, each of said retainer members being positioned on the pattern marks on said support surface.

7. The game apparatus of claim 6, including placement means for facilitating positioning said blocks into and removing them from said tray.

8. The game apparatus of claim 7, wherein said placement means includes an elongated handle, one end of which has a resilient suction cup thereon adapted for releasably engaging each of said blocks.

9. The game apparatus of claim 6, wherein said placement means includes a magnetic material in each of said blocks and including an elongated handle with a magnet on one end.

10. The game apparatus of claim 9, wherein each of said blocks is comprised of a cubical member of nonmagnetic material, an insert of magnetic material embedded in each of the six faces of the member, and a skin covering the outside of said member over said inserts.

11. The game apparatus of claim 1 wherein each of said polyhedronal blocks is a cube.

12. In a game apparatus, the improvement comprising:

a plurality of cubical blocks, each of which has a first side, second side, third side, fourth side, fifth side, and sixth side, the sides of each of said blocks having thereon a proportionate square piece of a composite artistic design which is complete when all the blocks are positioned together in side-by-side relationship in proper orientation to each other with a selected side of each in a common plane such that the characteristic lines, forms, and colors of the first design run continuously in a non-disjointed manner from each block to adjacent blocks, each of said first, second, third, fourth, fifth and sixth artistic designs having similar characteristics to at least two other of the designs in a manner such that each square side of each design has at least one edge at which the portion of design at said one edge matches in lines, forms, and colors the portion of design at one edge of a side of an adjacent block and at least one other edge at which the portion of design at said other edge on said side substantially matches in lines, forms, and colors the portion of design at the corresponding other edge of the piece of comparable location in at least one other of the designs, at least one of which designs is different than at least one of said other designs having a portion substantially matching the design portion at said one edge.

13. The game apparatus of claim 12, wherein all the six respective faces of comparable location of the six designs are on respectively separate sides of a common block.

14. The game apparatus of claim 13, wherein each face on a common block is marked with a designation common to the faces on that block and exclusive of the faces on any of the other blocks and each face is marked to indicate its proper orientation as to top, bottom, left, and right in the design.

15. The game apparatus of claim 14, including a tray for holding said blocks, the bottom of said tray being marked with the respective common designation of each block to indicate the proper position of said block in said tray relative to the proper positions of the other of said blocks as necessary for placement of said blocks to present a complete design.

* * * * *